US006554719B2

(12) United States Patent
Peters et al.

(10) Patent No.: US 6,554,719 B2
(45) **Date of Patent: *Apr. 29, 2003**

(54) CORRELATED SET OF GOLF CLUBS

(75) Inventors: Michael R. Peters, Vista, CA (US); Richard L. Rugge, Encinitas, CA (US); Bret Wahl, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/029,692

(22) Filed: Dec. 20, 2001

(65) Prior Publication Data

US 2002/0082108 A1 Jun. 27, 2002

Related U.S. Application Data

(63) Continuation of application No. 09/275,693, filed on Nov. 29, 2000, now Pat. No. 6,358,158, which is a continuation of application No. 09/504,017, filed on Feb. 18, 2000, now Pat. No. 6,183,376, which is a continuation of application No. 09/021,024, filed on Feb. 9, 1998, now Pat. No. 6,093,112.

(51) Int. Cl.[7] ..... A63B 53/04
(52) U.S. Cl. ..... 473/291; 473/342; 473/350
(58) Field of Search ..... 473/287–291, 473/335, 350, 342, 349

(56) References Cited

U.S. PATENT DOCUMENTS

| | | | |
|---|---|---|---|
| 835,735 A | * 11/1906 | Robertson |
| 3,655,188 A | 4/1972 | Solheim |
| 3,984,103 A | 10/1976 | Nix |
| 4,147,349 A | 4/1979 | Jeghrens |
| 4,645,207 A | 2/1987 | Teramoto et al. |
| 4,715,601 A | 12/1987 | Lamanna |
| 4,802,672 A | 2/1989 | Long |
| 5,154,377 A | 10/1992 | Suk |
| 5,160,136 A | 11/1992 | Eger |
| 5,261,663 A | 11/1993 | Anderson |
| 5,333,872 A | 8/1994 | Manning et al. |
| 5,380,004 A | 1/1995 | Teramoto |
| 5,388,826 A | 2/1995 | Sherwood |

(List continued on next page.)

FOREIGN PATENT DOCUMENTS

| | | |
|---|---|---|
| EP | 0 517 487 A1 | 2/1992 |
| GB | 2 316 011 | 6/1997 |
| JP | 304 5407 | 11/1997 |

OTHER PUBLICATIONS

The Club Scene. Golf Shop Operations (G50). p. 29. Jan. 1998.
Earlyfield. Adevertisement. 1 page.
Browning 440 Woods Irons (advertisement) 9/76 Golf Digest.
ENA 1998 Collection. Brochure from 2/98 PGA Show in Japan. p. 11 & 12.
Nicklaus 1998 Product Catalog. PGA Show in Orlando. Jan. 30–Feb. 2, 1998.
Taylor Made 1/97 Brochure.
FX Pro–Set brochure from 1/97 PGA Show.

*Primary Examiner*—Stephen Blau
(74) *Attorney, Agent, or Firm*—Knobbe, Martens, Olson & Bear, LLP.

(57) ABSTRACT

Disclosed is a set of golf clubs. The clubs are divided into at least a first group and at least a second group of golf clubs. The first group desirably comprises a plurality of club heads each having a main body of low density metallic material. The second group of golf clubs desirably comprises a plurality of club heads each having a main body of higher density metallic material than the density of the metallic material of the main body of each of the heads of the first group. The first group of clubs desirably comprises lower numbered clubs than the second group of clubs.

4 Claims, 12 Drawing Sheets

U.S. PATENT DOCUMENTS

| | | | | |
|---|---|---|---|---|
| 5,413,336 | A | | 5/1995 | Iwanaga |
| 5,423,535 | A | | 6/1995 | Shaw |
| 5,480,145 | A | | 1/1996 | Sherwood |
| 5,547,194 | A | | 8/1996 | Aizawa |
| 5,643,103 | A | * | 7/1997 | Aizawa |
| 5,658,209 | A | | 8/1997 | Blakemore |
| 5,665,009 | A | | 9/1997 | Sherwood |
| 5,665,014 | A | | 9/1997 | Sanford |
| 5,669,825 | A | | 9/1997 | Shira |
| 5,722,900 | A | | 3/1998 | Sung |
| 5,833,551 | A | | 11/1998 | Vincent et al. |
| 5,921,869 | A | | 7/1999 | Blough et al. |

* cited by examiner

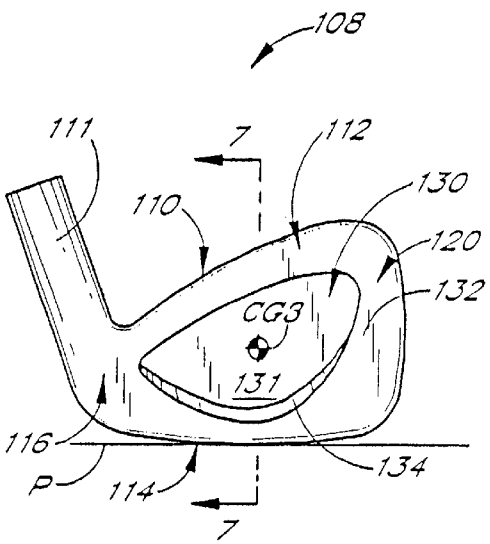
FIG. 6
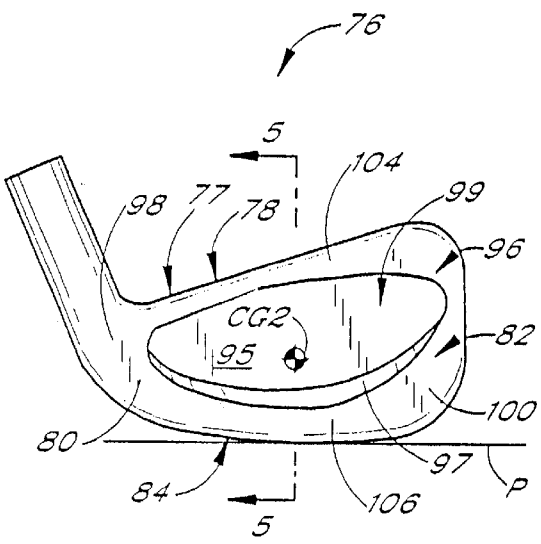
FIG. 4
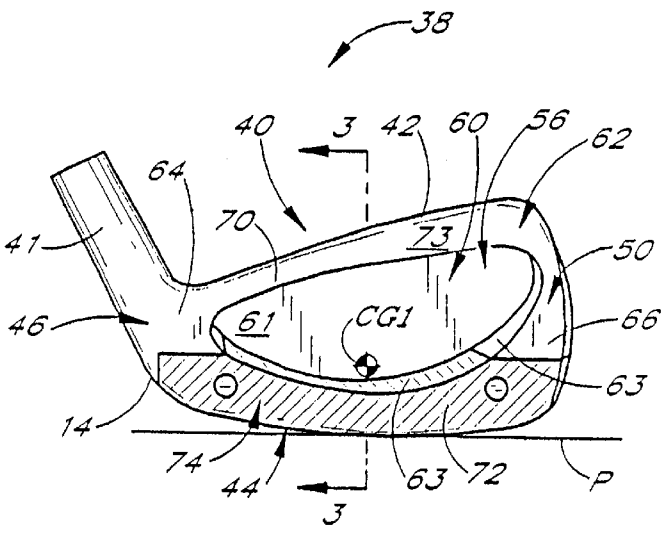
FIG. 2
FIG. 3
FIG. 5
FIG. 7

CORRELATED SET OF GOLF CLUBS

PRIORITY INFORMATION

This application is a continuation of U.S. application Ser. No. 09/725,693, filed Nov. 29, 2000, now issued as U.S. Pat. No. 6,358,158, which is a continuation of U.S. application Ser. No. 09/504,017, filed Feb. 18, 2000, now issued as U.S. Pat. No. 6,183,376, which is a continuation of U.S. application Ser. No. 09/021,024, filed Feb. 9, 1998, now issued as U.S. Pat. No. 6,093,112.

BACKGROUND OF THE INVENTION

1. Field of the Invention

The present invention relates to golf. More particularly, the present invention relates to a set of iron-type golf clubs.

2. Description of the Related Art and Summary of the Invention

A typical set of golf clubs includes a set of wood-type clubs for hitting the ball off the tee and for long shots, a set of iron-type clubs for long, medium, and short shots, and a putter to roll the ball on the green. Of all the clubs in a set, the iron-type clubs, or "irons," typically encounter the most variations in shot distances and the most variations in ground, obstacle and lie conditions.

The irons are numbered with designations from 1 through 9 and with individual wedge designations. For example, the iron which could essentially be designated number 10 is designated PW (pitching wedge). Additional wedges are often provided to provide even greater loft to the ball than a pitching wedge. Within a set, the higher the number designation, the greater the loft of the club. The lower numbered or long irons hit the ball the longest distance and are the most difficult to play, as it is relatively hard for the average golfer to get the ball airborne with the long irons. Golf club manufacturers thus try to design long irons that are easier to hit and more forgiving of off-centered shots. The medium numbered irons hit the ball a medium distance. The medium irons are typically designed to be both easy to hit and accurate. The shortest irons hit the ball the shortest distance and are used to land the ball closer to the target. As the location where the ball lands on the green is critical, more controllability and precision over the ball is required for the short irons. For the average golfer it is much easier to get the ball airborne with the short irons than with the long irons.

Unlike woods and putters, golfers typically purchase the irons as a correlated set which includes a large range of clubs. The clubs in such a set are designed to work together to reliably provide a golfer with predictable and progressive increments in shot distance from the lower numbered clubs to the higher numbered clubs. For example, a certain golfer may hit the ball 150 yards using the 7 iron, 160 yard using the 6 iron, 170 yards using the 5 iron, and so on. Thus, a golfer playing with a correlated set of irons may choose with confidence the iron that is most suited for the particular shot type and shot distance being encountered. This is not necessarily true with a random collection of irons where the incremental difference in shot distance between the clubs may not be coordinated.

Additionally, each of the clubs in a correlated set typically share a consistent look, such as consistent markings, color combinations, or the type of polishing or texture of the club head and shaft. Although the common features do not necessarily affect the playability of the clubs, golfers generally feel most comfortable when playing with a correlated set of irons, rather than with a group of irons that was randomly collected. A correlated set of irons thus contributes to the important mental aspects of a golfer's game by increasing the golfer's confidence when hitting the ball.

Golf club manufacturers progressively vary certain standard structural features of the irons in a correlated set to achieve the difference in ball distance from the lower numbered to the higher numbered clubs. For example, the loft angle of the clubs, which is the angle between a vertical plane passing through the shaft axis and a plane passing through the strike surface of the club head, progressively increases moving from the long irons to the short irons. The greater loft angle in the short irons gives these irons an increased tendency to lift the ball upon impact so that the ball travels a shorter distance. Another standard structural feature that is varied is the length of the club shaft, which decreases moving from the long clubs to the short clubs. The lie angles of the irons are also varied to accommodate the different lengths of shafts throughout the complete set of iron clubs.

U.S. Pat. Nos. 5,480,145, 5,665,009, and 5,388,826 to Sherwood disclose a correlated set of golf clubs having features that vary progressively from the lower numbered clubs to the higher numbered clubs. For example, the long irons have a larger planar strike area than the shorter irons to increase the size of the sweet spot for the long irons. These patents also disclose that the size of the rear cavity on the irons may decrease as the club shaft becomes shorter.

While manufacturers have varied the aforementioned features throughout the clubs in a single set of irons, there are also certain fundamental or basic design characteristics that have conventionally remained constant or homogeneous throughout all of the clubs in a coordinated, conventional set of irons. For example, one correlated set of irons may have a "cavity back" design wherein all of the clubs in the set have a cavity on the rear face of the club head. The cavity promotes a peripheral distribution of mass to increase the size of the sweet spot of the club and thereby makes the club easier to hit. Another correlated set of irons may have a "blade" design wherein all of the club heads generally are in the shape of a flattened blade. The blade design concentrates more mass directly behind the ball for a more solid and more controllable shot than the cavity-back irons. Specifically, a blade design provides the golfer with greater feedback to enable the golfer to more precisely alter a stroke to achieve the desired results. Thus, the cavity-back type of irons generally provide a more forgiving, although less controllable, shot than blade-type irons.

Yet another basic design characteristic that typically remains constant throughout all of the clubs in a coordinated, conventional set of irons is the material that is used to manufacture the club heads. For example, one correlated set of irons may comprise heads manufactured of titanium, which is a strong, lightweight material. Unfortunately, a set of titanium clubs is extremely expensive because of the high cost of titanium. Another correlated set of iron clubs may have heads that are manufactured of steel. A set of steel clubs is less expensive than titanium clubs.

Unfortunately, the performance of the specific clubs in a set may be adversely affected if all of the clubs include the same basic design characteristics. For example, the increased precision of the blade design may not be optimal for the long irons, where the emphasis should be toward enhancing the playability of the clubs by making it easier to get the ball airborne. Likewise, the cavity-back design is not necessarily suited for the shortest irons, which should emphasize feel and feedback and, therefore, controllability of the ball.

Additionally, the material used to manufacture the club head should not necessarily be consistent throughout all of the clubs in a correlated set. The use of light-weight titanium is highly suited for the longer irons, where the weight savings allows the club head to be made larger to increase the size of the sweet spot. However, using titanium may be inefficient and unnecessarily costly for the shorter irons, where controllability of the ball, rather than weight savings, is emphasized.

The design characteristics of the clubs should be specifically directed toward improving the specific playing needs of each of the clubs or groups of clubs in the set. For example, the properties of easy playability and forgiveness should be promoted for the long irons. The property of controllability of the shot should be promoted for the short irons. The middle irons should preferably be designed to compromise between playability and precision. These objectives are not necessarily accomplished if the clubs in a correlated set are united by a single, basic design characteristic.

There is therefore a need for a correlated set of golf clubs wherein each club or a group of clubs in the set utilizes technology that is specifically designed to promote the playing needs of that particular type of club.

In one aspect of the invention, there is disclosed a correlated set of golf clubs, comprising at least a first iron having a first club head. The first club head has a first loft designation and a first center of gravity located a first vertical distance from the ground plane when the club head is in address position. The set also comprises a second iron having a second club head. The second club head has a second loft designation designating a higher loft than the first loft designation and a second center of gravity located a second vertical distance from the ground plane when the club head is in address position. The second vertical distance is longer than the first vertical distance. The set further comprises a third iron having a third club head, the third club head having a third loft designation designating a higher loft than the second loft designation and a third center of gravity located a third vertical distance from the ground plane when the club head is in address position. The third vertical distance is longer than the second vertical distance.

Another aspect of the invention relates to a correlated set of golf clubs. The set comprises a first iron having a first club head, the first club head having a loft designation "3" and a first center of gravity located a first vertical distance from the ground plane when the club head is in address position; a second iron having a second club head, the second club head having a loft designation of one of "2" and "4" and a second center of gravity located a second vertical distance from the ground plane when the club head is in address position; a third iron having a third club head, the third club head having a loft designation of "5" and a third center of gravity located a third vertical distance from the ground plane when the club head is in address position; and a fourth iron having a fourth club head, the fourth club head having a loft designation of one of "4" and "6" and a fourth center of gravity located a fourth vertical distance from the ground plane when the club head is in address position. Each of the club heads have a unique loft designation and the first vertical distance is shorter than either of the third vertical distance and the fourth vertical distance. Additionally, the second vertical distance is shorter than either of the third vertical distance and the fourth vertical distance.

In yet another aspect of the invention, there is disclosed a correlated set of golf clubs, comprising a first iron having a first club head, the first club head having a loft designation "3" and a first center of gravity located a first vertical distance from the ground plane when the club head is in address position; a second iron having a second club head, the second club head having a loft designation "4" and a second center of gravity located a second vertical distance from the ground plane when the club head is in address position; a third iron having a third club head, the third club head having a loft designation of "5" and a third center of gravity located a third vertical distance from the ground plane when the club head is in address position; a fourth iron having a fourth club head, the fourth club head having a loft designation "6" and a fourth center of gravity located a fourth vertical distance from the ground plane when the club head is in address position; a fifth iron having a fifth club head, the fifth club head having a loft designation "7" and a fifth center of gravity located a fifth vertical distance from the ground plane when the club head is in address position, wherein none of the loft designations are identical and the first vertical distance is shorter than the fifth vertical distance, and the second vertical distance is shorter than the fifth vertical distance; and a sixth iron having a sixth club head, the sixth club head having a loft designation "8" and a sixth center of gravity located a sixth vertical distance from the ground plane when the club head is in address position. Each of the first vertical distance, the second vertical distance, the third vertical distance and the fourth vertical distance are at least as short as each of the fifth vertical distance and the sixth vertical distance.

In yet another aspect of the invention, there is disclosed a set of golf clubs comprising at least a first group of golf clubs, wherein each of the clubs in the first group comprises a club head having a main body of a first material having a first density; and at least a second group of golf clubs, wherein each of the clubs in the second group comprises a club head having a main body of a second material having a second density higher than the first density, wherein the first group of clubs comprise lower numbered clubs than the second group of clubs. Desirably, each of the clubs heads of the first group of clubs comprises a face, a sole, and a rear cavity surrounded by a peripheral belt of mass, and a separate weight insert of material having a higher density than the first density. The weight insert is positioned on a lower portion of the peripheral belt of mass so as to shift the center of gravity of the each of the club heads of the first group toward the sole. Each of the heads of the second group of clubs comprises a face, a sole, and a rear cavity surrounded by a unitary peripheral belt of mass.

In one embodiment, each of the club heads in the second group is made entirely of a single piece of the same type of one of metal and metal alloy. Each of the club heads of the second group includes at least one weight insert positioned on a lower portion of the peripheral belt of mass of the club heads of the second group. The weight inserts of the club heads of the first and second groups group are positioned below annular surfaces surrounding the rear cavities of the club heads.

In one embodiment, each of the club heads of the second group further comprises a separate face insert. The face insert of each of the club heads of the second group is manufactured of titanium. In another embodiment, the face insert of each of the club heads of the second group is manufactured of one of a titanium alloy, aluminum and an aluminum alloy. The at least one weight insert of each of the club heads of the second group is desirably made of a tungsten alloy. The first material mentioned above desirably comprises one of titanium and a titanium alloy, and the weight inserts of the first set of clubs are made of a tungsten-based material. The second material comprises one of steel and a steel alloy.

Another embodiment additionally comprises a third group of clubs, wherein each of the clubs in the third group comprises a club head having a face and a sole wherein the clubs of the third group have lower numbers than the clubs of the second group and wherein the clubs heads of the third group are made of higher density material than the club heads of the first group. The club heads of the third group are preferably made of steel and may have a rear cavity surrounded by a peripheral belt of mass.

The first group of clubs may comprises clubs from the set of 1, 2, 3, 4, 5, and 6 numbered clubs; the second group of clubs may comprises clubs from the set of 7, 8, and 9 numbered clubs and the pitching wedge; and the third group of clubs may comprise clubs from the set of the approach wedge, the sand wedge, and the lob wedge.

Yet another embodiment additionally comprises a fourth group of clubs having higher numbers than the clubs of the third group, wherein each of the clubs in the fourth group comprises a club head having a face and a sole and wherein the club heads of the fourth group are made of higher density material than the club heads of the first group. The club heads of the fourth group are desirably made of steel.

In one embodiment, the first group of clubs comprises clubs from the set of 1, 2, 3, 4 and 5 numbered clubs; the second group comprises clubs from the set of 6 and 7 numbered clubs; the third group comprises clubs from the set of 8 and 9 numbered clubs and a pitching wedge; and the fourth group comprises clubs from the set of the approach wedge, the sand wedge, and the lob wedge. A single piece of packaging preferably enclosing the set of golf clubs.

Yet another aspect of the invention relates to a set of golf clubs. The set comprises a first group of golf clubs, each of the first group of golf clubs having a head and a loft designation, and a second group of golf clubs, each of the second group of golf clubs having a head and a loft designation. The loft designation of each of the first group of golf clubs and each of the second group of golf clubs is unique. Additionally, each loft designation of the second group of golf clubs is higher than each loft designation of the first group of golf clubs. Each of the first group of golf clubs and the second group of golf clubs has a substantially same strike surface indicia and substantially the same loft designation typestyle. Desirably, the head of each of the first group of golf clubs differs from the head of each of the second group of golf clubs in at least one from the group of density and the existence of separate weight inserts.

BRIEF DESCRIPTION OF THE DRAWINGS

These and other features of the invention will now be described with reference to the drawings of a preferred embodiment, which are intended to illustrate and not to limit the invention, and in which:

FIG. 2 is a rear view of a long iron-type golf club head of the present invention;

FIG. 3 is a cross-sectional view of the golf club head of FIG. 2 along line 3—3;

FIG. 4 is a rear view of a middle iron-type golf club head of the present invention;

FIG. 5 is a cross-sectional view of the golf club head of FIG. 4 along line 5—5;

FIG. 6 is a rear view of a short iron-type golf club head of the present invention;

FIG. 7 is a cross-sectional view of the golf club head of FIG. 6 along line 7—7;

DETAILED DESCRIPTION OF THE PREFERRED EMBODIMENT

Figure 1:
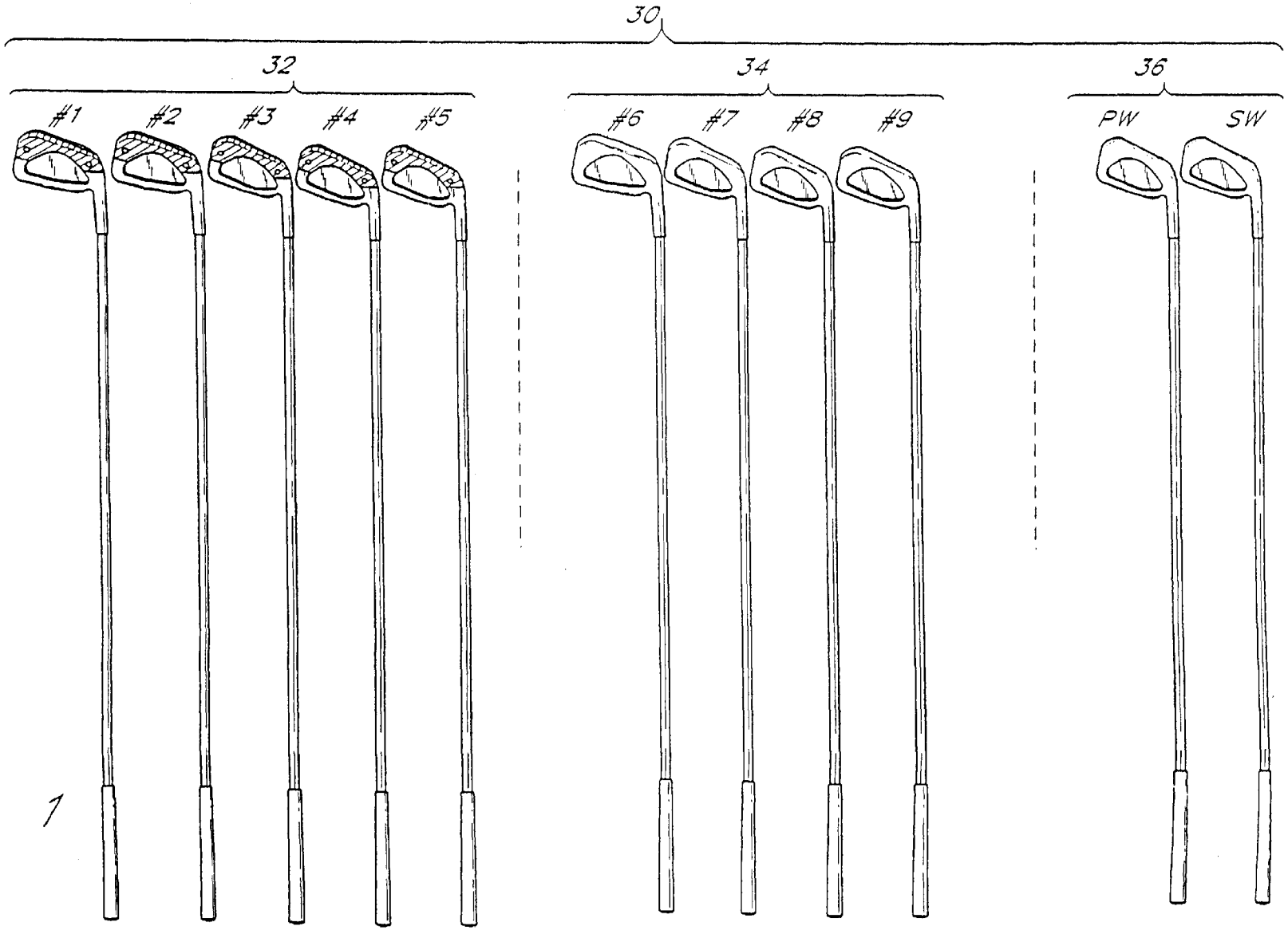
FIG. 1 is a side view of a set of iron-type golf clubs of the present invention.

FIG. 1 shows a set 30 of iron-type golf clubs. The set 30 generally comprises a first group 32 of iron-type golf clubs, a second group 34 of iron-type golf clubs, and a third group 36 of iron-type golf clubs. Each golf club within a common group has structural properties that are selected to enhance the specific playing requirements of the type of club within the group, as described in more detail below. The structural properties of the clubs provide a unique trend in the vertical positions of the centers of gravity of the club heads in the set 30 wherein the vertical distance of the center of gravity to ground is smaller for the long irons than the medium or short irons, as described in more detail below.

Figure 29:
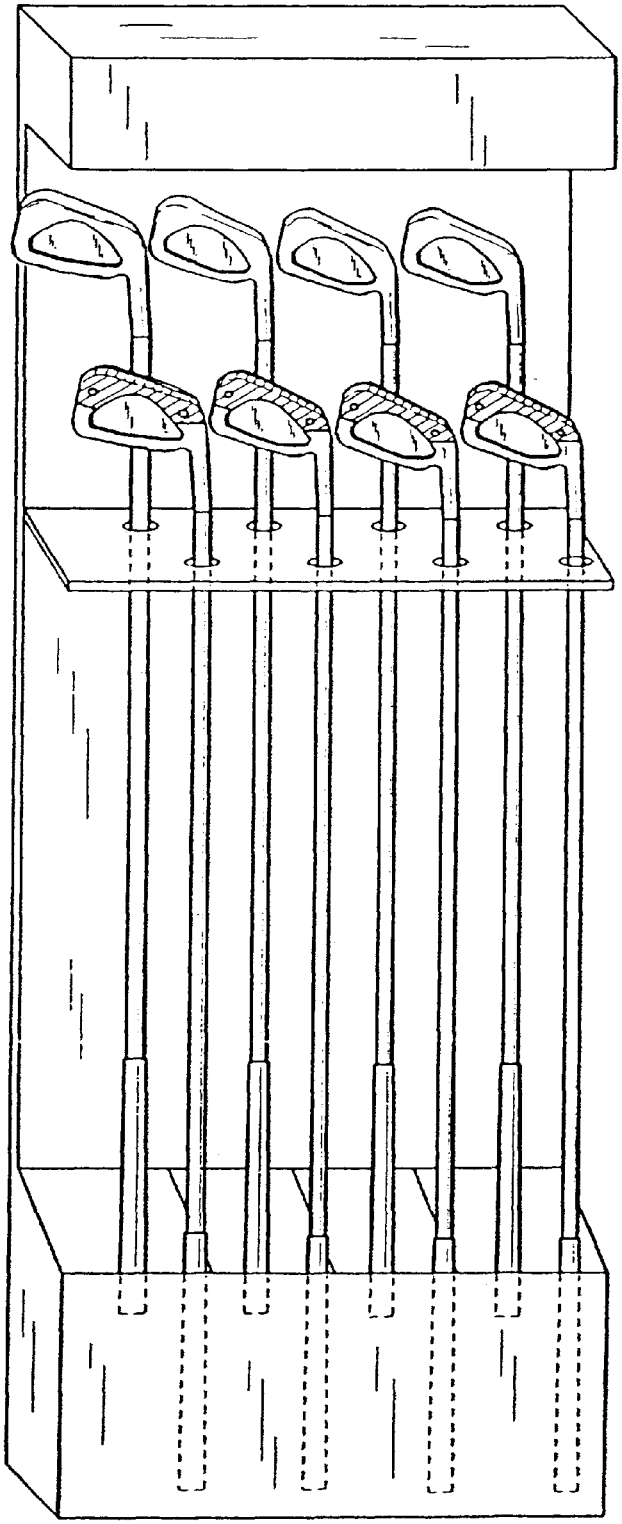
FIG. 29 is a perspective view of a packaged set of golf clubs of the present invention.

In the embodiment shown in FIG. 1, the first group 32 preferably includes the long irons, such as, for example, the 1, 2, 3, 4 and 5 irons. The second group 34 preferably includes the middle or medium irons, such as, for example, the 6, 7, 8 and 9 irons. The third group 36 preferably includes the short irons, such as, for example, the sand wedge and the pitching wedge. Preferably, each club is only within one of the groups 32, 34, or 36 for a given set 30 of clubs. Desirably, as shown in FIG. 29, the entire set 30 of clubs is packaged within a single piece of packaging, such as a carton designed for shipment and, preferably, display of the set of irons.

In another embodiment, the first group 32 includes the 1–4, 1–5, or 1–6 irons, the second group 34 includes the next clubs in sequence after the last club in the first group 32 up to the 9 iron or pitching wedge, and the third group 36 includes the next clubs in sequence after the last club in the second group 34 up to the lob wedge.

The numerical indicia of each club in the set 30 may also be described with reference to associated loft angles of the clubs. In one embodiment, the clubs have the loft angles set forth below with a variance in the range of ±4°.

| | |
|---|---|
| 1 iron | 16° |
| 2 iron | 19° |
| 3 iron | 21° |
| 4 iron | 24° |
| 5 iron | 27° |
| 6 iron | 30° |
| 7 iron | 33° |
| 8 iron | 37° |
| 9 iron | 41° |
| pitching wedge | 45° |
| approach wedge | 50° |
| sand wedge | 55° |
| lob wedge | 60° |

Figure 1A:
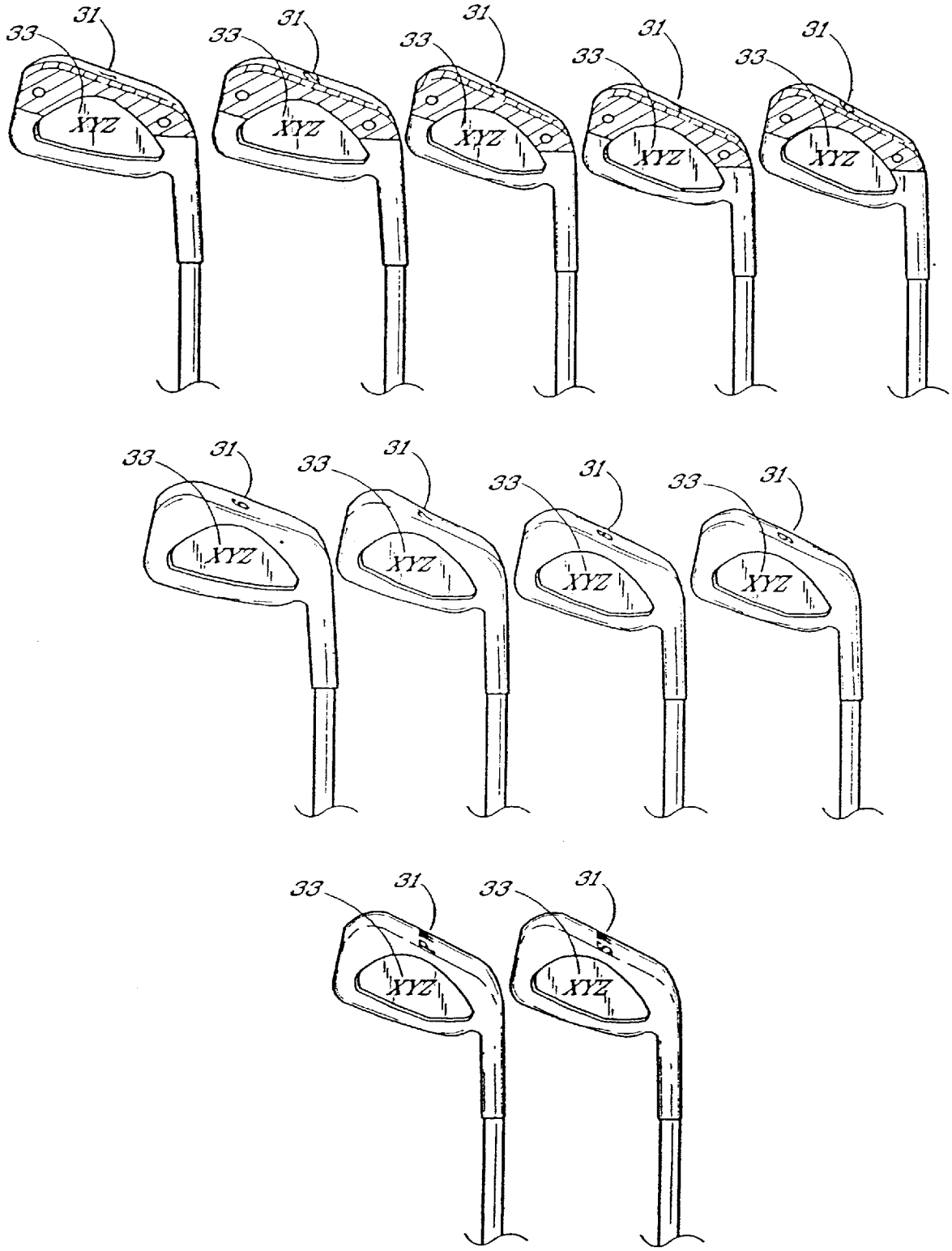
FIG. 1A is an enlarged side view of the heads of the golf clubs of FIG. 1.

As shown in FIG. 1A, each of the clubs in the set 30 includes a unique marking 31 which denotes the loft designation or club number of each of the clubs. The marking 31 typically comprises a numeral, but could also comprise any other symbols, such as a letter. Although the particular marking 31 is unique for each of the clubs, the typestyle or font of the marking 31 is desirably identical for each of the clubs. Each of the clubs in the set 30 also includes a designation or logo 33 which, for example, may designate the source of the clubs. In the illustrated embodiment, the logo 33 is shown as "XYZ" although any of a wide variety of symbols may be used. Desirably, the logo 33 and the associated typeset or font is identical for all of the clubs in the set 30. The set 30 could include other consistent markings or indicia that indicate that the clubs belong to the set 30.

FIG. 2 is a rear view of an iron-type golf club head 38 from the first group 32. FIG. 3 is a cross-sectional side view of the club head 38 along line 3—3 of FIG. 2. All four iron heads in the first group 32 have the same general structure, which generally comprises a main body 40 and a weight insert 74 attached thereto, as described in more detail below. A hosel 41 extends upwardly from the main body 40 for attaching to a shaft in a well known manner. The main body 40 includes an upper portion 42, a lower portion or sole 44, a heel portion 46 and a toe portion 50. The main body 40 further includes a front side 52 (FIG. 3) that defines a strike surface 54 for striking a golf ball, and a rear side 56 which includes a rear cavity 60 that extends into the golf club head 38 toward the front side 52. The rear cavity 60 forms a substantially flat back or base surface 61 that is opposed to the strike surface 54. An annular surface 63 extends outwardly from the base surface 61 and defines the periphery of the rear cavity 60.

The strike surface 54 is oriented at a loft angle A relative to a line I—I passing through the axis B of the hosel 41. The loft angle A gradually increases as the club number increases for the clubs in the first group 32. Thus, although the club heads in the first group 32 have the same general structure, at least the loft angle desirably differs for each of the clubs in the first group 32.

The rear cavity 60 of the golf club head 38 is surrounded by a peripheral mass belt 62 comprising an extent of mass that surrounds the rear cavity 60. The peripheral mass belt 62 promotes a peripheral distribution of mass to maximize the inertia and increase the "sweet spot" of the golf club head 38.

The peripheral mass belt 62 includes a heel perimeter region 64 extending generally upwardly along the heel portion 46 of the club head 38, and a toe perimeter region 66 extending generally upwardly along the toe portion 50 of the club head 38. The peripheral mass belt 62 further includes an upper perimeter region 70 extending longitudinally along the upper portion 42 between upper edges of the heel perimeter region 64 and the toe perimeter region 66, and a lower perimeter region 72 extending longitudinally along the sole portion 44 of the club head 38 between lower edges of the heel perimeter region 64 and the toe perimeter region 66. The peripheral mass belt 62 forms a substantially flat rear surface 73. The peripheral mass belt 62 could also extend only partially around the rear cavity 60 and could vary in thickness at various locations.

A weight insert 74 is attached to the main body 40 and forms the lower perimeter region 72 of the peripheral mass belt 62. As best shown in FIG. 2, the weight insert 74 extends horizontally along the lower perimeter region 72 and slightly upward along the toe perimeter region 66 and the heel perimeter region 64 so that the weight insert has a crescent-like shape. As shown in FIG. 3, the weight insert 74 has a thickness that extends from the rear surface 73 of the peripheral mass belt 62 to the base surface 61 of the rear cavity 60 so that the peripheral mass belt 62 forms the lower region of the annular surface 63. The weight insert 74 is preferably located in a very low position on the club head 38 and toward the rear side 56 of the club head 38. Any suitable means, may be used to attach the weight insert 74 to the golf club head 38 such as, for example, screws, adhesion bonding, welding, brazing, press fitting, or any combination thereof.

The main body 40 preferably constitutes the main portion of the volume of the club head 38. Preferably, the weight insert 74 represents 20% to 70% of the total weight of the club head 38 but comprises less than 50% of the total volume of the club head 38. More preferably, the weight insert 74 represents 35% to 60% of the total weight of the club head 38. Even more preferably, the weight insert 74 represents 45% to 60% of the total weight of the club head 38. As an example, for a 3-iron head having a total weight of 245 grams, the weight insert 74 is preferably approximately 100 grams, or 41% of the total weight of the 3-iron head. The main body 40 of the golf club head 38 is preferably made of a material having a low density (i.e., less than 7 grams per cubic centimeter). However, the main body 40 should also have high mechanical characteristics, such as a high elastic strength. In one embodiment, the main body 40 of the golf club head 38 is manufactured of titanium or a titanium alloy having a density of approximately 4.5 grams per cubic centimeter. Suitable materials are a Ti—6Al—4V-type alloy, which has an elastic strength on the order of 120,000 psi, or a Ti—3Al—2.5V-type alloy, which has an elastic strength on the order of 90,000 psi.

The weight insert 74 is preferably manufactured of a high density material (i.e., greater than at least 10 grams per cubic centimeter, and preferably between 12 and 20 grams per cubic centimeter). Some suitable materials for the weight insert 74 are tungsten, which has a density of approximately 19 grams per cubic centimeter, or a sintered mixture of tungsten and other metallic powders, such as iron, nickel, and/or copper. Preferably, the weight insert 74 does not increase the total weight of the club head 38 above a desired value, preferably 245 grams for a 3-iron, but rather redistributes the mass in a predetermined manner to enhance the hitting characteristics of the clubs in the first group 32. That is, the position, shape, and material of the weight insert 74 is particularly directed toward the playing needs or requirements of the long irons, with which golfers generally have a difficult time getting the ball airborne.

As mentioned, the weight insert 74 is generally located in the sole portion 44 of the club head 38 so that the weight insert 74 has a low position on the club head 38. The low position of the weight insert 74 significantly lowers the center of gravity $CG_1$ of the club head 38 so that more mass is below the golf ball at impact, which facilitates launching of the ball. Additionally, a weight insert which extends from the toe portion 50 to the heel portion 46, such as the crescent-like shaped weight insert 74 illustrated in FIG. 2, creates a high moment of inertia about a vertical axis through the center of gravity to thereby provide more forgiveness for off-center hits. The position of the weight insert 74 on the rear side 56 also improves the playability of the club head 38. The structure of the club head 38 of the first group 32 thus particularly improves the playability of the long irons by making it easier for the golfer to get the ball airborne and providing more forgiveness for off-center shots.

FIG. 4 is a rear view of a golf club head 76 from the second group 34. FIG. 5 is a cross-sectional view of the golf club head 76 along line 5—5 of FIG. 4. All of the club heads in the second group 34 have the same general structure of the club head 76, which is particularly directed toward enhancing the playing needs of the medium irons. However, at least the loft angle A differs between the club heads in the second group.

The golf club head 76 generally comprises a unitary main body 77 which is formed of a single piece of material and does not have a weight insert. The main body 77 includes an upper portion 78, a heel portion 80, a toe portion 82, and a lower portion or sole 84. The main body 77 also includes a front side 86 having a front strike surface 90 oriented at a loft angle A and a rear side 92 having a rear cavity 94 that extends toward the strike surface 90. The rear cavity 60 forms a substantially flat rear or base surface 95 that is opposed to the strike surface 54. An annular surface 97 extends outwardly from the base surface 94 and defines the periphery of the rear cavity 92.

A peripheral mass belt 96 extends around the perimeter of the cavity 94 and preferably forms a continuous extended mass that surrounds the cavity 94. The peripheral mass belt 96 includes a heel perimeter region 98 extending generally upward along the heel portion 80 and a toe perimeter region 100 extending generally upwardly along the toe portion 82. The peripheral mass belt 96 further includes an upper perimeter region 104 extending longitudinally along the upper portion 78 between upper edges of the heel perimeter region 98 and the toe perimeter region 100, and a lower perimeter region 106 extending longitudinally along the sole portion 84 between lower edges of the heel perimeter region 98 and the toe perimeter region 100. As mentioned, the peripheral mass belt 96 comprises a single extent of mass of the golf club head 76 illustrated in FIGS. 4 and 5 and thus does not include a weight insert like the golf club head 38 of the first group 32.

The club head 76 of the second group 34 desirably has a similar general shape as the club head 38 of the first group 32. However, the club head 76 of the second group 34 is preferably smaller in size than the club head 38 in the first group 32 in order to provide more precision or control in the shot while still having a relatively large sweet spot. The club head 76 is thus suited for the medium irons, which should emphasize both precision and playability. The set 30 could also be divided into two groups, wherein the first group includes the 1–4, 1–5, or 1–6 irons and the second group includes the next clubs in sequence after the last club in the first group up to the lob wedge.

The club head 76 of the second group 34 is preferably manufactured of a material having a higher density than the main body 40 of the club head 38 of the first group 32. Desirably, the club head 76 is manufactured of a material having a density greater than 5 grams per cubic centimeter, and more preferably between 6 and 9 grams per cubic centimeter. The aforementioned range of densities allows for the production of heads with the aforementioned structure and also allows the manufacturer to position the center of gravity to suit playing needs of the clubs in the second group 34.

The choice of a higher density material also allows the club head 76 in the second group 34 to be made smaller in size while maintaining the conventional total weight of the head. A 7-iron has a conventional total head weight of approximately 270 grams. Preferably, the club head 76 in the second group 34 is manufactured of a steel or a steel alloy. Advantageously, steel is less expensive than titanium so that the cost of the set 30 of clubs is reduced by using steel where appropriate.

FIG. 6 is a rear view of a club head 108 from the third group 36. FIG. 7 is a cross-sectional view of the club head 108 along line 7—7 of FIG. 6. As mentioned, the third group 36 of clubs heads preferably includes the short irons, such as the pitching wedge and the sand wedge. All club heads in the third group 36 have the same general structure of the club head 108, which is particularly directed toward enhancing the playing needs of the short irons, such as improving the control of these irons. Desirably, the position of the centers of gravity $CG_1$, $CG_2$, $CG_3$, gradually moves upward relative to the sole portions of the clubs moving from the first group 32 to the second group 34, to the third group 36, as described in greater detail below.

The club head 108 generally comprises a unitary main body 110 having a hosel 111 extending upwardly therefrom. The main body 110 includes an upper portion 112, a sole portion 114, a heel portion 116, and a toe portion 120. The club head 108 also includes a front side 122 having a strike surface 124, and a rear side 126 including a rear cavity 130.

The rear cavity 130 forms a rear or base surface 131 that is opposed to the strike surface 124. An annular surface 134 extends outwardly from the base surface 131 and defines the periphery of the rear cavity 92. A peripheral mass belt 132 surrounds the rear cavity 130.

The rear cavity 130 preferably has a volume that is smaller than the volume of the rear cavity 94 in the club head 76 of the second group 34. The distribution of mass to the periphery of the club head 108 is thus limited to thereby concentrate more mass behind the ball and improve the feel and control of the club head 108. Desirably, the volume of the rear cavity 130 may be reduced by varying the thickness t of the club head 108 in the region of the rear cavity 130. The thickness t is the distance from the strike surface 124 to the base surface 131 of the rear cavity 130.

FIG. 7 illustrates the preferred distribution of mass in the rear cavity 130. The base surface 131 includes a bulged or thick portion 138 at the center of the base surface 131. The thick portion 138 is formed by the base surface 131 curving outwardly so as to define an increased thickness t at the center of the base surface 131. The thickness t of the club head 108 preferably gradually decreases moving away from the thick portion 138 toward the annular surface 135 in order to form a progressive thickness variation. Desirably, the thickness t of the club head 108 in the region of the rear cavity 130 also increases toward the sole portion 114 to concentrate more mass near the sole portion 114 so that the center of gravity $CG_3$ of the club head 108 is relatively close to the sole portion 114. Desirably, the center of gravity $CG_3$ is approximately 0.7 inches from the bottom surface of the club head 108. Preferably, the bulged portion 138 is located behind the point on the strike surface 124 where the ball impacts the club head 108.

The club head 108 of the third group 36 is preferably made of a higher density material than the main body 40 of the club head 38 in the first group 30. The material may be the same or different as the material used to manufacture the club head 76 of the second group 34. However, if the material is different than that of the second group 34, the material is preferably of a higher density in the range of 7–9 grams per cubic centimeter. In a preferred embodiment, the club head 108 of the third group is manufactured of steel or a steel alloy. Appropriate materials also include nickel alloys and copper alloys.

FIGS. 8–14 illustrate alternative embodiments of the clubs heads from the first group 32, the second group 34, and the third group 36. For convenience, like numerals will be used to designate like parts between the two embodiments.

Figure 8:
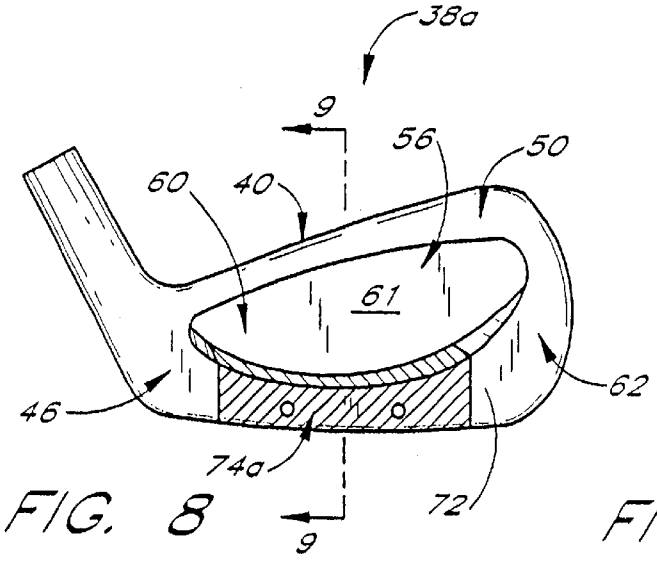
FIG. 8 is a rear view of a second embodiment of a long iron-type golf club head of the present invention.

FIG. 8 is a rear view of an alternative embodiment of a long iron club head 38*a* from the first group 32. The club head 38*a* has essentially the same structure as the club head 38 of the previous embodiment. However, in this embodiment, the weight insert 74*a* occupies a more central portion of the lower perimeter region 72 of the peripheral mass belt 62 so that the weight insert 74*a* is smaller from heel to toe in size than the weight insert 74 (FIG. 2) from the first embodiment. The weight insert 74*a* does not extend entirely from the toe portion 50 to the heel portion 46. The weight insert 74*a* lowers the center of gravity $CG_1$ of the club head 38*a*, as described above with respect to the previous embodiment. However, the moment of inertia around a vertical axis passing through the center of gravity is kept at a lower value than the club head 38 of the first embodiment to provide enhanced feedback to the golfer regarding off-center hits and force of impact.

Figure 10:
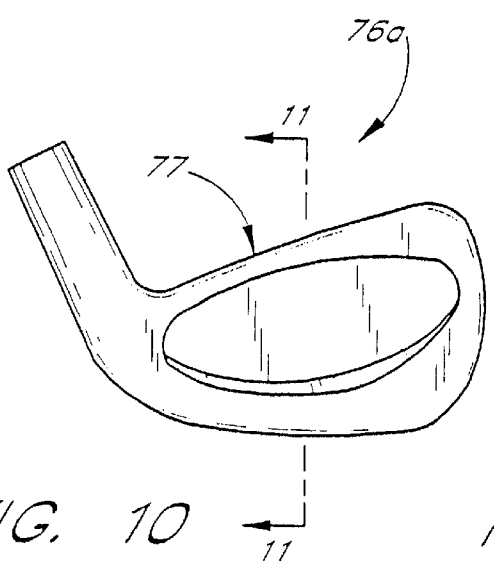
FIG. 10 is a rear view of a second embodiment of a middle iron-type golf club head of the present invention.
Figure 11:
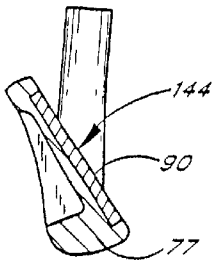
FIG. 11 is a cross-sectional view of the golf club head of FIG. 10 along line 10—10.
Figure 9:
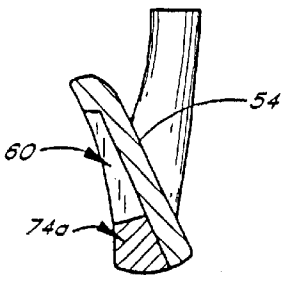
FIG. 9 is a cross-sectional view of the golf club head of FIG. 8 along line 9—9.
Figure 12:
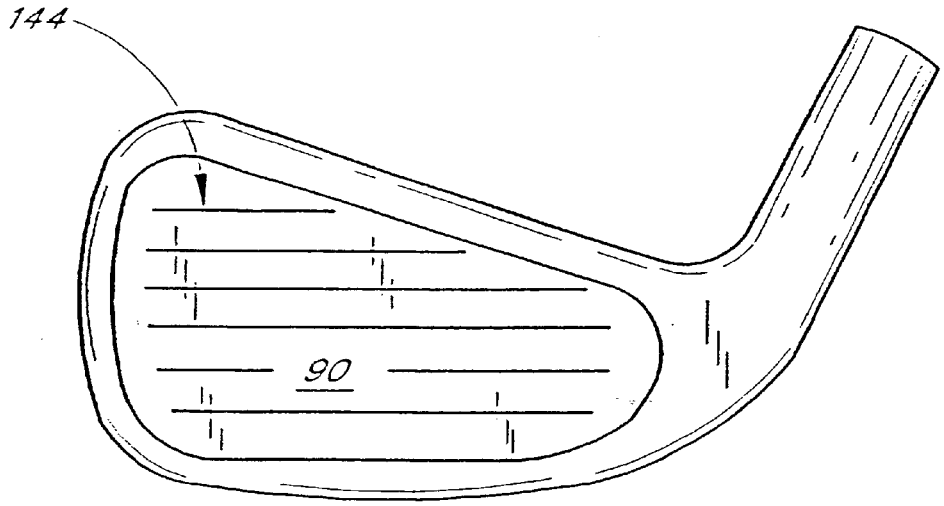
FIG. 12 is a front view of the golf club head of FIG. 10.

FIG. 10 is a rear view of a second embodiment of a club head 76*a* from the second group 34. FIG. 11 is a cross-sectional view of the club head 76*a* along line 11—11, and FIG. 12 is a front view of the golf club head 76*a*. The club head 76*a* has essentially the same structure as the club head 76 of the first embodiment. However, the club head 76*a* includes a separate face insert 144 that is attached to the front side 86 of the main body 77 of the club head 76*a*. The face insert 144 forms the strike surface 90. The face insert 144 is preferably formed of a material having a lower density than the density of the main body 77 of the head 76*a*. A thinner insert formed from an equivalent density, but higher strength material can also be utilized. Preferably, the face insert 144 is manufactured of titanium, a titanium alloy, aluminum or an aluminum alloy. The use of an insert 144 allows more weight to be distributed at the periphery of the head, thus increasing the moment of inertia of the head around a vertical and/or horizontal axis through the center of gravity. The insert also allows the strike face area to be increased for a given club head weight. The main body 77 of the head 76*a* is preferably manufactured of steel or a steel alloy.

Figure 13:
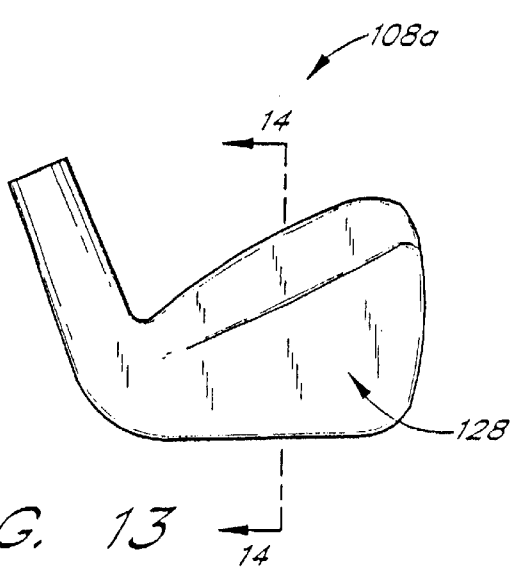
FIG. 13 is a rear view of a second embodiment of a short iron-type golf club head of the present invention.
Figure 14:
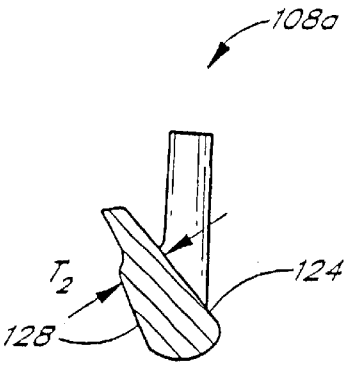
FIG. 14 is a cross-sectional view of the golf club head of FIG. 12 along line 13—13.

FIG. 13 is a rear view of another embodiment of the golf club head 108*a* from the third group 36. In this embodiment, the golf club head 108*a* does not include a rear cavity. Rather, the golf club head 108*a* is a blade-shaped iron head. The club head 108*a* comprises a unitary body having a flat strike surface 124 and a rear surface 128 opposed thereto. Preferably, the club head has a thickness $T_2$ from the strike surface 124 to the rear surface 128. The distribution of the thickness $T_2$ is preferably selected to concentrate more mass in a central region behind the strike surface 124. As best shown in FIG. 14, the thickness $T_2$ is greater behind the point where the ball should impact the strike surface 124 to provide a more solid shot and increase the precision of the club head 108*a*. The thickness $T_2$ gradually decreases or becomes constant moving upward toward the upper portion 112 so that the thickness $T_2$ is lowest at an upper edge 148.

Figure 15:
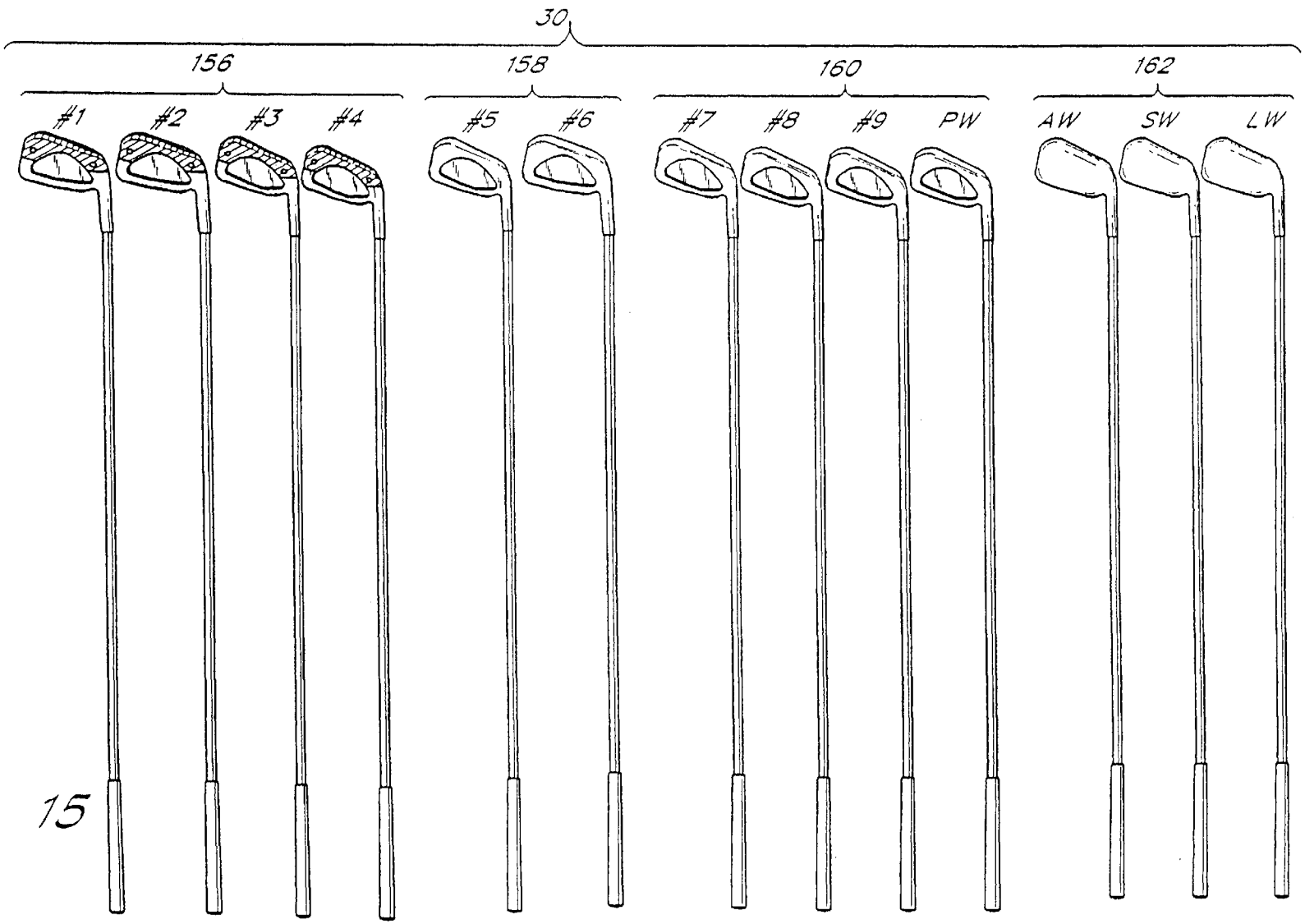
FIG. 15 is a side view of another embodiment of the set of iron-type golf clubs of the present invention.

With reference to FIG. 15, an alternative embodiment of the set 30 of irons includes thirteen irons that are divided into four groups including a first group 156, a second group 158, a third group 160 and a fourth group 162. In the illustrated embodiment, the first group 156 includes the 1, 2, 3, and 4 irons, the second group 158 includes the 5 and 6 irons, the third group 160 includes the 7, 8, and 9 irons and the pitching wedge (PW), and the fourth group 162 includes the gap or approach wedge (AW), the sand wedge (SW), and the lob wedge (LW). The distribution of the irons within the groups could be varied, although each iron of the alternative embodiment is preferably within only one of the groups 156, 158, 160, and 162. The particular club heads used in the groups shown in FIG. 15 are one specific example and could be varied.

In another embodiment, the first group 156 includes the 1–4 irons, the 1–5 irons, or the 1–6 irons. The second group 158 includes the next clubs in sequence after the last club from the first group, up to the 6, 7, or 8 iron. The third group 160 includes the next clubs in sequence after the last club in the second group 158, up to the pitching wedge. The fourth group 162 includes the approach wedge, the sand wedge, and the lob wedge. Alternatively, the alternative embodiment of the set 30 could include 3 groups wherein a first group includes the 1–4, 1–5, or 1–6 irons, the second group includes the next clubs in sequence after the last club in the first group up to the 9 iron or pitching wedge, and the third group includes the next clubs in sequence after the last club in the third group up to the lob wedge.

Figure 16:
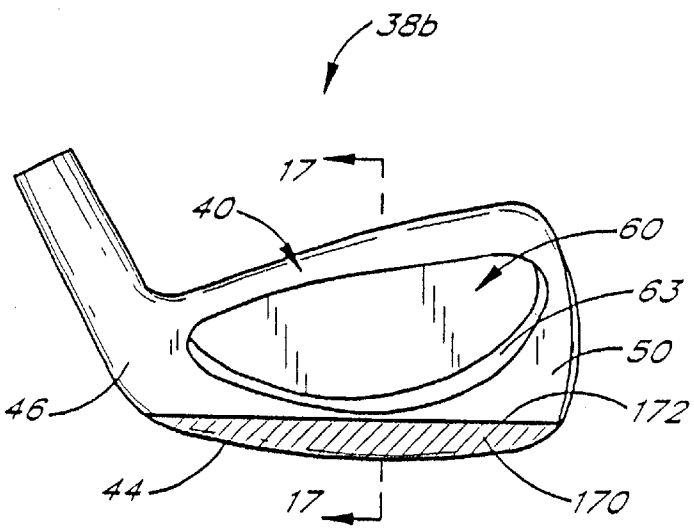
FIG. 16 is a rear view of a long iron-type club of the set of FIG. 15.
Figure 17:
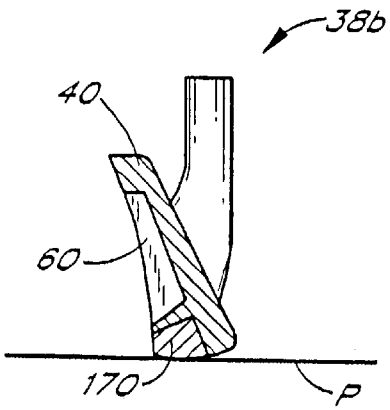
FIG. 17 is a cross-sectional view of the club of FIG. 16 along line 17—17.

With reference to FIGS. 16 and 17, there is shown an exemplary club head 38*b* from the first group 156. The club head 38*b* has the same general structure as the club head 38 described above with respect to FIGS. 2 and 3. However, the club head 38*b* includes a uniquely-shaped weight insert 170 attached to the main body 40, as described more fully below. For convenience, like reference numerals will be used between like parts of the club heads 38 and 38*b*.

The weight insert 170 extends entirely across the main body 40 from the heel portion 46 to the toe portion 50 and downwardly to the sole 44. The weight insert 170 has a substantially straight upper edge 172 that is positioned below the rear cavity 60. The weight insert 170 is thus positioned entirely below the rear cavity 60 and does not form any part of the annular surface 63 that surrounds the rear cavity 60.

Figure 18:
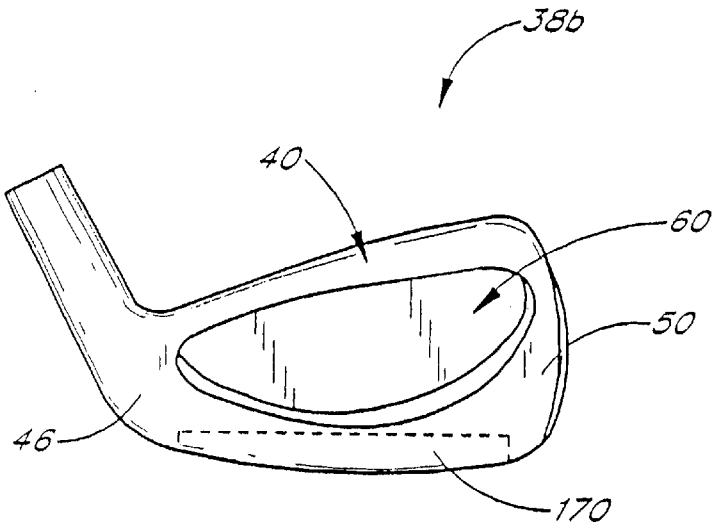
FIG. 18 is a rear view of a second embodiment of the club of FIG. 16.
Figure 19:
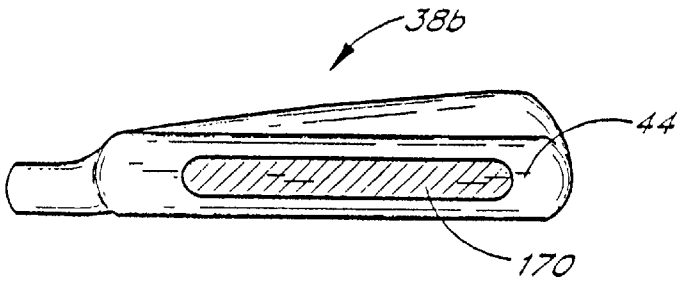
FIG. 19 is a bottom view of the club of FIG. 18.

FIGS. 18 and 19 show another embodiment of the club head 38*b*. In this embodiment, the weight insert 170 does not extend entirely from the heel portion 46 to the toe portion 50, but rather occupies a more central region therebetween. The entire weight insert 170 is positioned below the rear cavity 60. As best shown in FIG. 19, the weight insert 170 of this embodiment is mounted within an internal cavity in the club head 38*b* so that the weight insert 170 is only visible from the sole 44 of the club head 38*b*.

The main body 40 of the club head 38*b* is desirably manufactured of a strong, lightweight material, such as titanium or of a titanium alloy, aluminum or an aluminum alloy. The weight insert 170 is desirably manufactured of a heavier material than the main body 40, such as tungsten alloy. The use of light-weight titanium or aluminum is highly suited for the long irons of the first group 156. The weight savings provided through the use of titanium or aluminum allows the club head 38*b* to be made larger and increase the size of the sweet spot. The weight insert 170 advantageously lowers the position of the center of gravity of the club head 38*b*, as described in more detail below.

The position of the weight insert 170 provides certain advantages. The low position relative to the rear cavity 60 facilitates manufacturing of the club head 38*b*. Because the weight insert 170 does not break into the annular surface 63 surrounding the rear cavity 60, the weight insert does not have to be shaped to match the shape of the annular surface 63. This eliminates additional finishing processes that are often necessary to smoothly blend the juncture between the weight insert and the annular surface surrounding the rear cavity in cases where the weight insert breaks into the annular surface.

Figure 20:
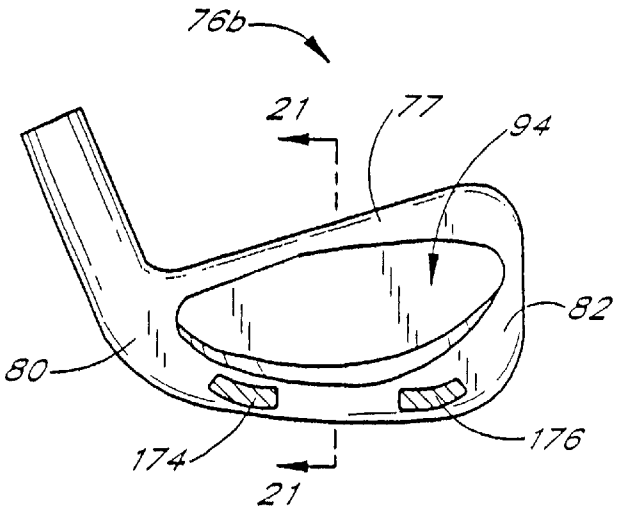
FIG. 20 is a rear view of a middle iron-type golf club of the set of FIG. 15.
Figure 21:
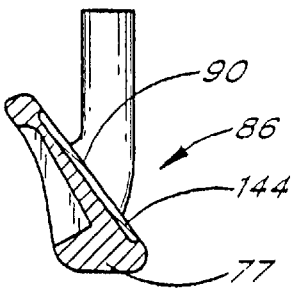
FIG. 21 is a cross-sectional view of the club of FIG. 20 along line 21—21.

With reference to FIGS. 20 and 21, there is shown an exemplary club head 76*b* from the second group 158. The club head 76*b* has the same general structure as the club head 76*a* as described above with respect to FIGS. 10 and 11. Thus, like reference numerals will be used between like parts of the club heads 76*a* and 76*b*. As best shown in FIG. 20, the club head 76*b* includes a first weight insert 174 and a second weight insert 176 that are attached to the main body 77 of the club head 76*b*. The first weight insert 174 is positioned below the rear cavity 94 near the heel portion 80 of the club head 76*b*. The second weight insert 176 is positioned near the toe portion 82 such that it has a shape and position that preferably mirrors the shape and position of the weight insert 174.

Figure 22:
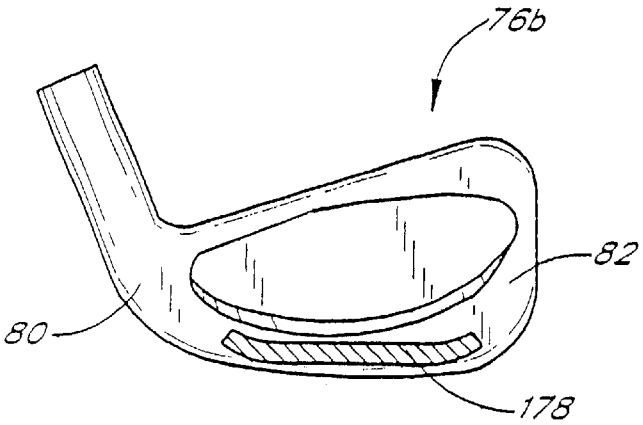
FIG. 22 is a rear view of another embodiment of the club of FIG. 20.

In another embodiment of the club head 76*b* shown in FIG. 22, the weight inserts 174 and 176 are replaced by a single weight insert 178 that extends from the heel portion 80 to the toe portion 82 of the club head 76*b*. The weight insert 178 or weight inserts 174 and 176 could also be mounted within a cavity in the club head 76*b*, such as was described above with respect to the club head 38*b* shown in FIGS. 18 and 19.

With reference to FIG. 21, the club head 76*b* could also include a face insert 144 that is attached to the front side 86 of the main body 77 of the club head 76*b*. The face insert 144 forms the strike surface 90 of the club head 76*b*. The club head 76*b* could be equipped with any combination of the face insert 144 and the weight inserts 174, 176, or 180 on the main body 77.

The main body 77 of the club head 76*b* is desirably manufactured of a hard material, such as steel. The face insert 144 is desirably manufactured of a stronger and/or lighter material than the main body 77, such as titanium or aluminum, and the weight inserts 174 and 176 (or the weight insert 178) are desirably manufactured of a higher density material than the main body 77, such as a tungsten alloy. The use of a face insert 144 enhances perimeter weighting. Additionally, light-weight face inserts reduce the amount of weight consumed in the region of the strike surface 90. The weight savings allows more mass to be used in the periphery of the club head 76*b* to thereby increase the stability of the club head 76 for off-centered shots. Because the relatively high-priced titanium or aluminum is only used for the face insert 144, the cost of the club head 76*b* is lower than if the entire club head 76*b* were manufactured of titanium or aluminum.

Figure 23:
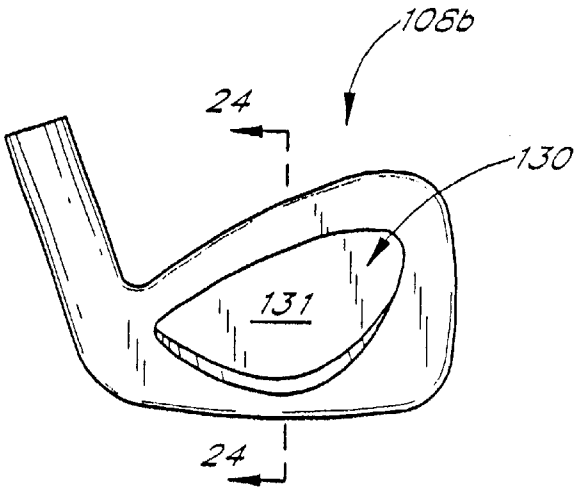
FIG. 23 is a rear view of a short iron-type golf club of the set of FIG. 15.
Figure 25:
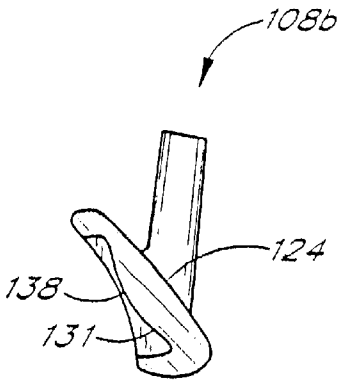
FIG. 25 is another embodiment of the club of FIG. 23.
Figure 24:
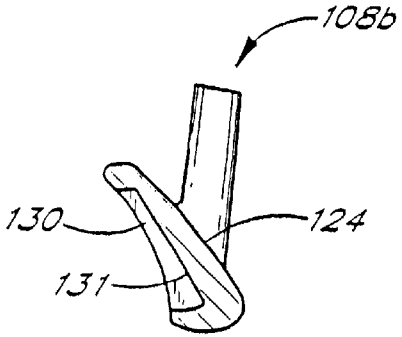
FIG. 24 is a cross-sectional view of the club of FIG. 23.

With reference to FIGS. 23–25, there is shown an exemplary club head 108*b* from the third group 160. The club head 108*b* has the same structure of the club head 108 as described above with respect to FIGS. 6 and 7. Thus, like reference numerals will be used between like parts of the club heads 108 and 108*b*. As mentioned above with respect to FIG. 7, the club head 108*b* includes a bulged or thick portion 138 (FIG. 25) immediately behind the theoretical point of impact of the strike surface 124 on the ball. The thick portion 138 could be eliminated on the lower numbered clubs so that the rear surface 131 of the rear cavity 130 is substantially flat, such as shown in FIG. 24. It is contemplated that the thickness between the rear surface 131 on the rear cavity 130 and the strike surface 124 could gradually increase moving from the lower-numbered to the higher-numbered irons of the third group 160 so that the size of the thick portion 138 also gradually increases. The club head 108*b* is desirably manufactured of steel.

Figure 26:
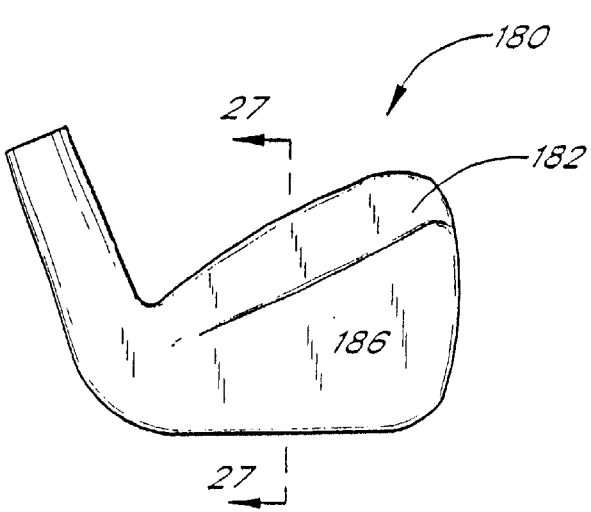
FIG. 26 is a rear view of a wedge-type iron club of the set of FIG. 15.
Figure 27:
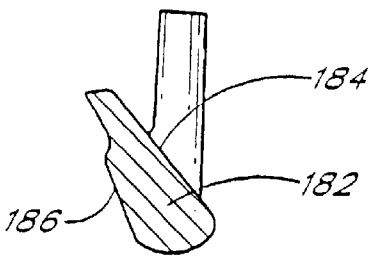
FIG. 27 is a cross-sectional view of the club of FIG. 26.

FIGS. 26 and 27 show an exemplary club head 180 from the fourth group 162. The club head 180 is a blade-type club head having a unitary main body 182 that includes a flat strike surface 184 and a rear surface 186 opposed thereto. The distribution of the thickness between the strike surface 184 and the rear surface 186 is preferably selected to concentrate more mass in a central region behind the strike surface 184, preferably immediately behind the theoretical point of impact with a golf ball. This provides a more solid shot and increases the controllability of the ball when hit by the club head 180. This is highly desirable for the wedge-type irons that comprise the fourth group 162. The club head 180 is desirably manufactured of forged or cast steel.

Figure 28:
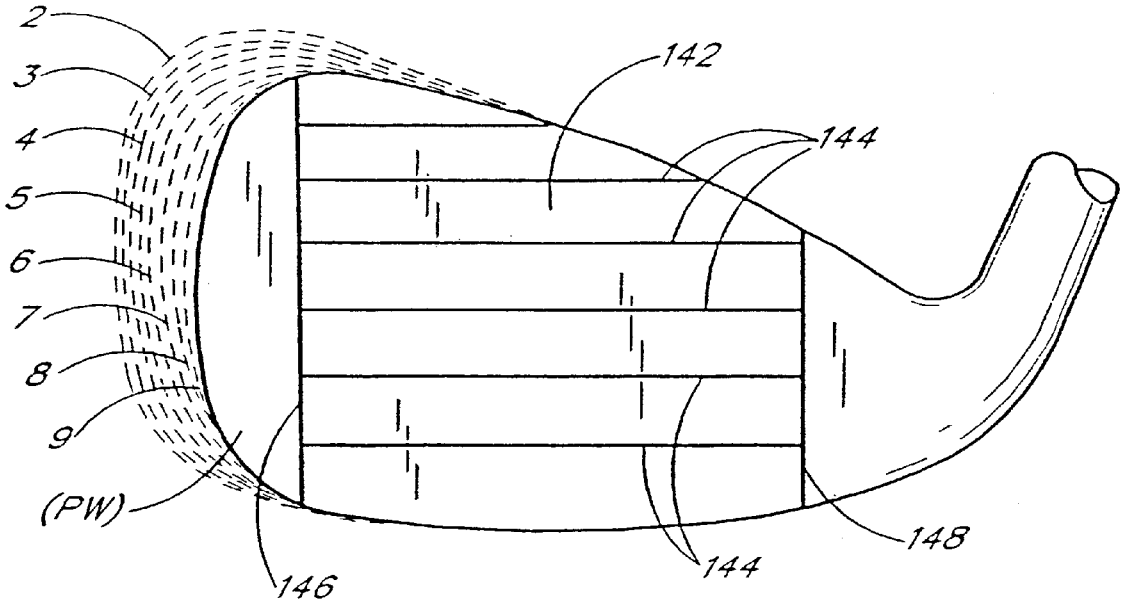
FIG. 28 illustrates the possible variation in size of the strike surfaces of the golf club heads of the present invention.

FIG. 28 shows a general feature which may be common to all of the club heads in the first, second, and third groups 132, 134, and 136, respectively. The strike surface (referred to generally using reference numeral 142) of each of the clubs in the set 30 may increase progressively in size from the shorter clubs to the longer clubs (i.e., from the sand wedge to the number 2 club). Advantageously, the increase in the size of the strike surface 142 provides a gradual increase in the size of the sweet spot. The greater sweet spot size increases the likelihood of a desirable result even on off-centered shots. The larger size of the sweet spot for the long irons thus increases the golfer's confidence and contributes to the important psychological aspects of the game. Alternatively, the size of the strike surface of the irons in the set 30 could remain substantially constant.

With reference to FIG. 28, the strike surface 142 desirably has predetermined indicia or markings that are identical for all of the clubs in the set 30 to identify the clubs as being part of the set 30. For example, the strike surface could include a predetermined pattern of grooves 144. The strike surface 142 could also include a left and right border lines 146 and 148. The area within the border lines 146 and 148 could be a different color than the rest of the club head to highlight the strike surface 142. Alternately, a single border line could surround the strike surface 142, such as is shown in FIG. 12.

If desired, the number of groups within the set 30 or the distribution of the irons within the groups may be varied. For example, in another embodiment, the set 30 may comprise two groups of clubs wherein the first group includes the 1, 2, 3, 4, 5, and 6 irons and the second group comprises the 7, 8, and 9 irons and the pitching wedge. The clubs that make up each group could also be varied. For example, the first group could comprises the 1, 2, 3, and 4 irons and the second group could comprise the 5, 6, 7, 8, and 9 irons and the pitching wedge. As mentioned, for a given set 30 of irons, each club is part of only a single group.

Figure 30:
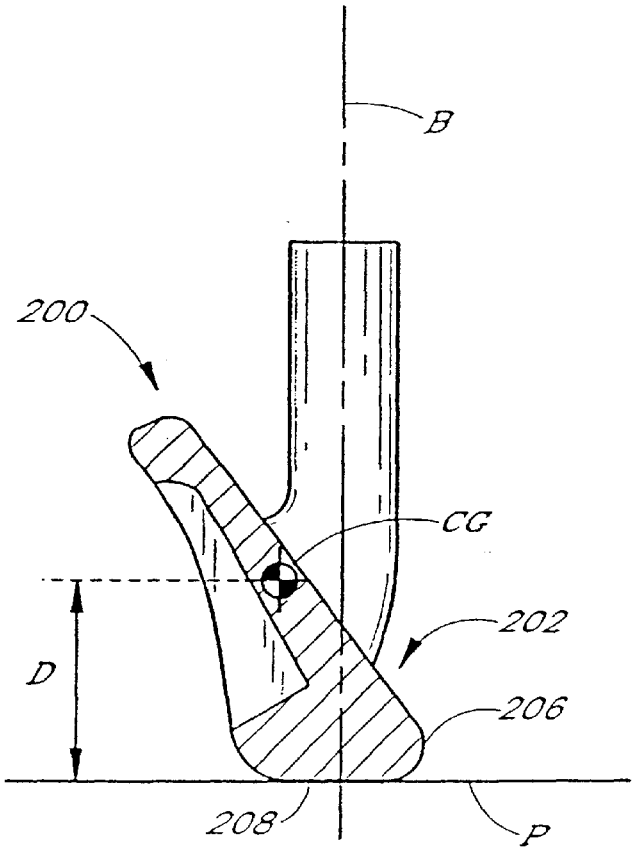
FIG. 30 is a side view of an iron club in an address position.
Figure 30A:
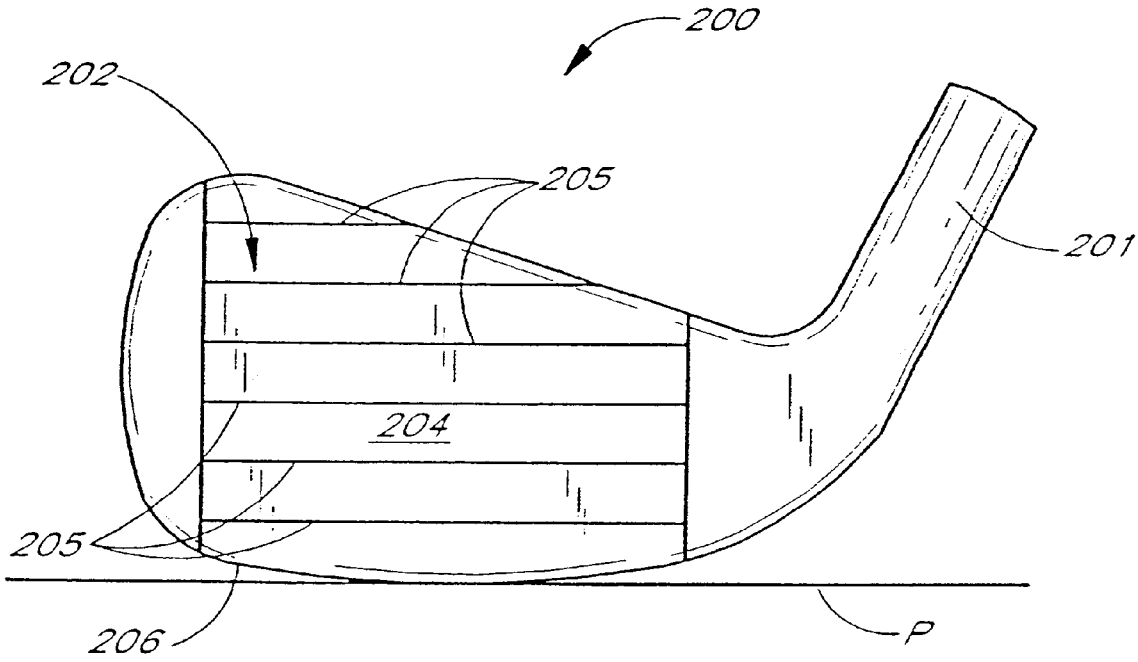
FIG. 30A is a front view of the iron club of FIG. 30.

The aforementioned structures of the club heads in the set 30 result in a unique trend regarding the vertical positions of the centers of gravity of the club heads in the set 30. That is, preferably, the vertical positions of the centers of gravity generally rise or at least remain steady relative to the bottom or sole of the clubs moving from the lower-numbered clubs to the higher-numbered clubs. With reference to FIGS. 30 and 30A, the vertical position of the center of gravity CG of an exemplary club head 200 from the set 30 is described with reference to the vertical position D of the center of gravity CG relative to a ground plane P. The club head 200 has a hosel 201, a front face 202 and a strike portion 204 thereon. The strike portion 204 contains grooves 205. A forward lower edge 206 connects the front face 202 with the sole 208 of the club head 200. The vertical position D of the center of gravity CG is the vertical distance between the center of gravity CG and a ground plane P when the club head 200 is oriented at the address position with the grooves 205 parallel to the ground plane P and the axis B of the hosel 201 contained in a plane perpendicular to the ground plane P.

Figure 31:
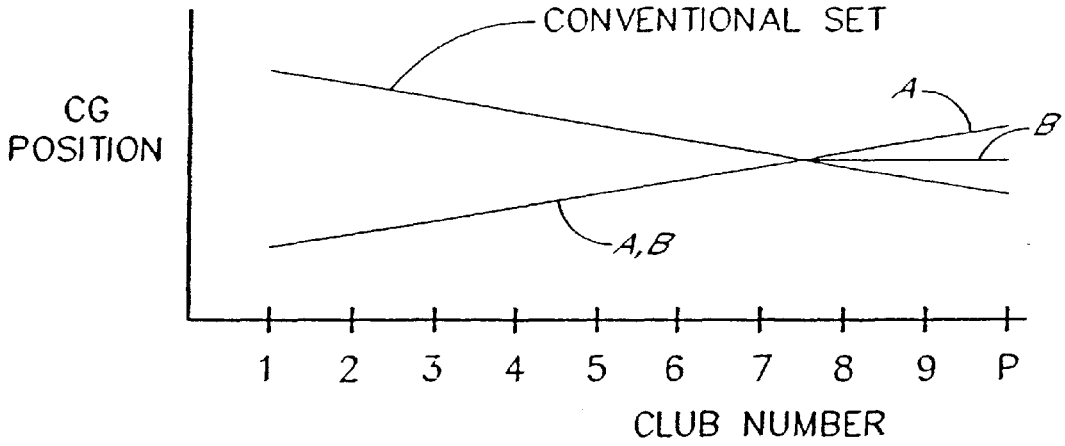
FIG. 31 is a graph showing the vertical position of the center of gravity of the clubs heads of the golf club set of the present invention as a function of club number.

FIG. 31 is a graph of the vertical positions of the centers of gravity of the clubs within the set 30. As shown, in one embodiment, referred to as embodiment A, preferably, the vertical positions of the centers of gravity generally rise moving from the number 1 iron to the pitching wedge. The vertical position D of the center of gravity of the clubs heads for embodiment A are as follows.

The vertical position D of the CG for the 1 iron may be from approximately 0.500–0.740 inches, preferably from approximately 0.610–0.650 inches, and is more preferably approximately 0.630 inches. The vertical position D of the CG for the 2 iron may be from approximately 0.500–0.740 inches, preferably from approximately 0.615–0.655 inches, and is more preferably approximately 0.635 inches. The vertical position D of the CG for the 3 iron may be from approximately 0.510–0.730 inches, preferably from approximately 0.620–0.660 inches, and more preferably is approximately 0.640 inches. The vertical position D of the CG for the 4 iron may be from approximately 0.510–0.730 inches, preferably from approximately 0.640–0.680 inches, and more preferably is approximately 0.660 inches. The vertical position D of the CG for the 5 iron may be from approximately 0.520–0.750 inches, preferably from approximately 0.660–0.700, and more preferably is approximately 0.680 inches. The vertical position D of the CG for the 6 iron may be from approximately 0.520–0.750 inches, preferably from approximately 0.680–0.720, and more preferably is approximately 0.700 inches. The vertical position D of the CG for the 7 iron may be from approximately 0.600–0.750 inches, preferably from approximately 0.685–0.725, and more preferably is approximately 0.705 inches. The vertical position D of the CG for the 8 iron may be from approximately 0.600–0.750 inches, preferably from approximately 0.690–0.730, and more preferably is approximately 0.710 inches. The vertical position D of the CG for the 9 iron may be from approximately 0.620–0.740 inches, preferably from approximately 0.695–0.735, and more preferably is approximately 0.715 inches. The vertical position D of the CG for the pitching wedge may be from approximately 0.620–0.740 inches, preferably from approximately 0.700–0.740, and more preferably is approximately 0.720 inches.

In another embodiment, referred to as embodiment B, preferably, the vertical positions of the centers of gravity generally rise from the number 1 iron to approximately the number 7 or 8 iron. The vertical positions then remain generally steady for the rest of the irons. The vertical position D of the center of gravity of the clubs heads for embodiment B are as follows.

The vertical position D of the CG for the 1 iron may be from approximately 0.500–0.740 inches, preferably from approximately 0.610–0.650 inches, and is more preferably approximately 0.630 inches. The vertical position D of the CG for the 2 iron may be from approximately 0.500–0.740 inches, preferably from approximately 0.615–0.655 inches, and is more preferably approximately 0.635 inches. The vertical position D of the CG for the 3 iron may be from approximately 0.510–0.730 inches, preferably from approximately 0.620–0.660 inches, and more preferably is approximately 0.640 inches. The vertical position D of the CG for the 4 iron may be from approximately 0.510–0.730 inches, preferably from approximately 0.640–0.680 inches, and more preferably is approximately 0.660 inches. The vertical position D of the CG for the 5 iron may be from approximately 0.520–0.750 inches, preferably from approximately 0.660–0.700, and more preferably is approximately 0.680 inches. The vertical position D of the CG for the 6 iron may be from approximately 0.520–0.750 inches, preferably from approximately 0.670–0.710, and more preferably is approximately 0.690 inches. The vertical position D of the CG for the 7 iron may be from approximately 0.600–0.750 inches, preferably from approximately 0.680–0.720, and more preferably is approximately 0.700 inches. The vertical position D of the CG for the 8 iron may be from approximately 0.600–0.750 inches, preferably from approximately 0.680–0.720, and more preferably is approximately 0.700 inches. The vertical position D of the CG for the 9 iron may be from approximately 0.620–0.740 inches, preferably from approximately 0.680–0.720, and more preferably is approximately 0.700 inches. The vertical position D of the CG for the pitching wedge may be from approximately 0.620–0.740 inches, preferably from approximately 0.680–0.720, and more preferably is approximately 0.700 inches.

In contrast, in a conventional set of irons the vertical positions of the centers of gravity gradually lowers moving from the lower numbered to the higher numbered clubs.

Certain advantages are associated with the aforementioned distribution of the centers of gravity of the clubs in the set 30. As mentioned, the low center of gravity of the long irons makes it easier for a golfer to get the ball airborne. The higher position of the center of gravity for the shorter irons reduces the likelihood of the shorter irons producing an overly high trajectory. The aforementioned club head structures provide advantages that are not present in a conventional set of irons.

Additional club head designs are disclosed in the following related patent applications, which are hereby incorporated by reference in their entirety: U.S. patent application Ser. No. 08/787,113, filed on Jan. 22, 1997, which is a continuation-in-part of U.S. patent application Ser. No. 08/711,267, filed on Sep. 9, 1996, which claims priority to U.S. Provisional Application No. 60/023,257, filed on Aug. 9, 1996.

Although the foregoing description of the preferred embodiment of the preferred invention has shown, described, and pointed out certain novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. A correlated set of golf clubs comprising:

a first group of golf clubs, wherein each of said golf clubs has a head and a loft designation, wherein each of the clubs in said first group comprises a club head having a main body of a first material having a first density, a face, a sole, a separate weight insert having a density higher than said main body and each club head having a first center of gravity located a first vertical distance from a ground plane when said head is in address position;

a second group of golf clubs, wherein each of said golf clubs has a head and a loft designation higher than said loft designations of said first group, wherein each of the clubs in said second group comprises a club head having a main body of a material having a second density that is higher than said first density, a face, a sole, a separate weight insert having a density higher than said main body and each club head having a second center of gravity located a second vertical distance from the ground plane when said head is in address position, said second vertical distance being longer than said first vertical distance; and a third group of golf clubs, wherein each of the clubs in said third group comprises a club head having a main body of a material having a density higher than said first density, each of said third group of golf clubs having a head and a loft designation designating a higher loft than said second group, and each club head having a third center of gravity located a third vertical distance from the ground plane when said head is in address position, said club head of each of the clubs in said third group being without a separate weight insert having a density higher than said density of its main body, such that said third vertical distance is at least equal to or longer than said second vertical distance.

2. The correlated set of golf clubs according to claim 1, wherein the main body of each of the club heads of said second group comprises a face insert.

3. The correlated set of golf clubs according to claim 2, wherein said face insert is in each of the club heads of said second group and said face insert comprises a material having a density less than the second density of the main body of each of the club head of said second group.

4. The correlated set of golf clubs according to claim 1, wherein said second group comprises up to at least a club number 9.

* * * * *